US005788774A

United States Patent [19]

Mccumiskey et al.

[11] Patent Number: 5,788,774

[45] Date of Patent: Aug. 4, 1998

[54] SUBSTRATE COATING ASSEMBLY EMPLOYING A PLUG MEMBER

[75] Inventors: Robert E. Mccumiskey; John S. Chambers; Rachael A. Forgit, all of Rochester, N.Y.

[73] Assignee: Xerox Corporation, Stamford, Conn.

[21] Appl. No.: 785,676

[22] Filed: Jan. 21, 1997

[51] Int. Cl.[6] ..... B05C 11/11

[52] U.S. Cl. ..... 118/505; 118/423; 118/428; 118/406; 118/500; 118/503; 118/504

[58] Field of Search ..... 118/423, 428, 118/406, 500, 503, 504, 505, DIG. 10, DIG. 11; 138/89; 4/295; 215/355; 220/789, DIG. 19

[56] References Cited

U.S. PATENT DOCUMENTS

| | | | |
|---|---|---|---|
| 1,979,706 | 11/1934 | Reamy | 220/DIG. 19 |
| 2,224,168 | 12/1940 | Tillyer et al. | 118/500 |
| 4,610,942 | 9/1986 | Yashiki et al. | 430/58 |
| 5,006,217 | 4/1991 | Koop | 118/503 |
| 5,089,110 | 2/1992 | Allen et al. | 118/500 |
| 5,120,627 | 6/1992 | Nozomi et al. | 430/59 |
| 5,186,477 | 2/1993 | Nakazawa et al. | 118/500 |
| 5,279,916 | 1/1994 | Sumino | 430/134 |
| 5,353,472 | 10/1994 | Benda et al. | 220/789 |
| 5,422,144 | 6/1995 | Speakman, Jr. | 427/430.1 |

FOREIGN PATENT DOCUMENTS

| | | | |
|---|---|---|---|
| 412232 | 4/1909 | France | 118/428 |
| 2949916 | 7/1980 | Germany | 118/505 |
| 3913978 | 11/1989 | Germany | 118/428 |
| 3928300 | 2/1991 | Germany | 4/295 |
| 3323306 | 12/1993 | Germany | 118/503 |
| 6-170318 | 6/1994 | Japan | 118/500 |
| 550250 | 5/1942 | United Kingdom | 138/89 |

OTHER PUBLICATIONS

Hawley's Condensed Chemical Dictionary, 12th Ed., p. 5, 1993.

*Primary Examiner*—Peter Chin
*Assistant Examiner*—Michael P. Colaianni
*Attorney, Agent, or Firm*—Zosan S. Soong

[57] ABSTRACT

There is disclosed an assembly for selectively coating a hollow, cylindrical first substrate defining a first open end region having an outer surface and an inner surface and a second open end region, the assembly including a first plug member fabricated from a nonwetting material, wherein the plug member has a bottom surface defining a pallet coupling feature and a top surface defining a cavity region encompassed by a circumferentially extending rigid side wall having an outer surface and an inner surface, wherein the first end region of the substrate is disposed in the cavity region where the inner surface of the side wall grips the outer surface of the first end region of the substrate to couple the first plug member to the first end region, whereby the plug member minimizes coating of the outer surface and the inner surface of the first end region of the substrate by a coating solution.

9 Claims, 3 Drawing Sheets

SUBSTRATE COATING ASSEMBLY EMPLOYING A PLUG MEMBER

BACKGROUND OF THE INVENTION

This invention relates to apparatus for selectively coating a substrate and for transporting the substrate during the coating process.

In electrophotography, and particularly in xerographic copying and printing machines, coated substrates such as photoreceptor belts or cylindrical photoreceptor drums are common. Photoreceptor embodiments include at least one coating of photoconductive material, which can be formed on the photoreceptor by known techniques such as immersion or dip coating.

The end regions of a coated photoreceptor are used to engage with flanges in a printer's or copier's drive mechanism and/or to support a developer housing. If the developer housing rides on the coated area at one end region of the drum, the coating composition is rubbed off and contaminates various components in the machine such as the cleaning system and any optical exposure systems employed in the machine. Also, the coating can interfere with devices that are designed to electrically ground the drum by merely riding on the outer surface at one end region of the drum. Thus, both the outer and inner end regions of a photoreceptor generally must be free of the coating composition.

In dip coating, the upper end region of the photoreceptor drum might be kept free of coating composition by orienting the drum vertically and dipping the drum into a bath of coating composition to a predetermined depth which avoids coating the upper end region. However, the coating formed over the lower end region of the photoreceptor must still be removed such as by mechanically or manually wiping the lower end region and/or by applying solvents to it. This removal precedure is problematic since it may employ environmentally harmful solvents. Also, the coating removal procedure may require the use and maintenance of special equipment in the clean room which increase activity in the clean room, thereby decreasing productivity. In addition, the coating removal procedure is typically carried out in the clean room which increases costs since the procedures must meet clean room requirements. Using TEFLON™ tape to mask the end region of the substrate is problematic since the tape can come off entirely or come off in pieces in the coating solution. In addition, removing the TEFLON™ tape may damage the coated layers of the photoreceptor. Thus, there is a need, which the instant invention addresses, for coating equipment which minimizes or eliminates the above-identified problems.

The following documents disclose coating methods, dip coating apparatus, and photosensitive members:

Speakman, Jr., U.S. Pat. No. 5,422,144, discloses a substrate coating method employing a sleeve member.

Yashiki et al., U.S. Pat. No. 4,610,942, discloses an electrophotographic member having corresponding thin end portions of charge generation and charge transport layers;

Nozomi et al, U.S. Pat. No. 5,120,627, discloses an electrophotographic photoreceptor having a dip coated charge transport layer; and Sumino et al., U.S. Pat. No. 5,279,916, discloses a process for producing an electrophotographic photosensitive member.

SUMMARY OF THE INVENTION

The present invention is accomplished in embodiments by providing an assembly for selectively coating a hollow, cylindrical first substrate defining a first open end region having an outer surface and an inner surface and a second open end region, the assembly comprising: (a) a first plug member fabricated from a nonwetting material, wherein the plug member has a bottom surface defining a pallet coupling feature and a top surface defining a cavity region encompassed by a circumferentially extending rigid side wall having an outer surface and an inner surface, wherein the first end region of the substrate is disposed in the cavity region where the inner surface of the side wall grips the outer surface of the first end region of the substrate to couple the first plug member to the first end region, whereby the plug member minimizes coating of the outer surface and the inner surface of the first end region of the substrate by a coating solution.

There are also provided in embodiments of the present invention the following additional components:

(b) a pallet having a plurality of identical plug member coupling features; and (c) a second plug member identical to the first plug member whereby the pallet coupling feature of the first plug member and of the second plug member has the same dimensions and is adapted to mate with one of the plug member coupling features of the pallet, but wherein the second plug member, to couple to an end region of a hollow, cylindrical second substrate having a different inner dimension than the first substrate, differs from the first plug member in that the cavity region and the side wall of the second plug member have different dimensions than the cavity region and the side wall of the first plug member.

BRIEF DESCRIPTION OF THE DRAWINGS

Other aspects of the present invention will become apparent as the following description proceeds and upon reference to the Figures which represent preferred embodiments.

DETAILED DESCRIPTION

Figure 1:
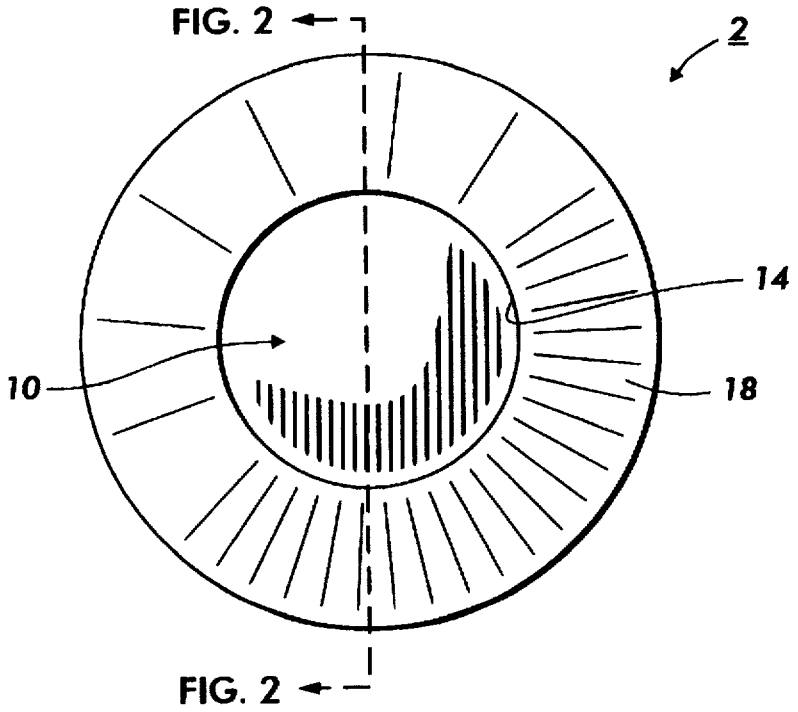
FIG. 1 represents a top view of the plug member.
Figure 2:
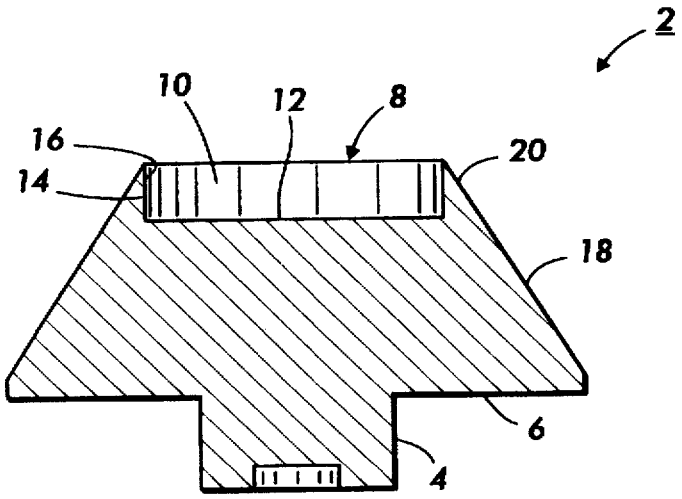
FIG. 2 represents a cross-sectional side view of the plug member of FIG. 1.

FIGS. 1–2 illustrate one embodiment of the plug member 2 where the pallet coupling feature 4 on the bottom surface 6 is a peg. In embodiments, the pallet coupling feature 4 may be a plurality of pegs such as two, three, or more. At the top surface 8 of the plug member 2, the cavity region 10 having a preferably flat bottom surface 12 is encompassed by a circumferentially extending rigid side wall 14. The height of the side wall 14 may correspond to the length of the end region of the substrate to be masked. The inner surface 16 of the side wall is preferably vertical. The side surface 18 of the plug member, which includes the outer surface 20 of the side wall 14, may be vertical or angled. Thus, the outer surface 20 of the side wall may be vertical or angled. The plug member is cone-shaped when the side surface 18 is angled. The dimensions of the cavity region 10 and the side wall 14 depend upon the dimensions of the end region of the substrate. Optionally, there is a plurality of circumferentially arranged channels (not shown) on the side surface of the plug member that facilitates coating solution flowoff. In another embodiment, there is an optional generally circular rigid interior wall (not shown) in the cavity region such that the end region of the substrate is sandwiched between the interior wall and the side wall of the plug member.

Figure 3:
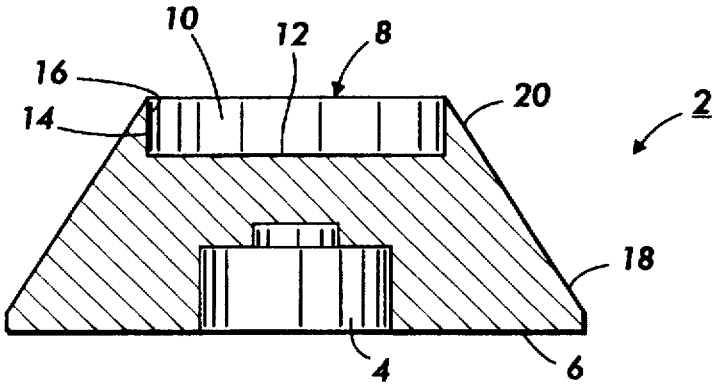
FIG. 3 represents a cross-sectional side view of another embodiment of the plug member of FIG. 2.

FIG. 3 illustrates another embodiment of the plug member 2 of FIGS. 1–2 where the pallet coupling feature 4 on the bottom surface 6 is a hole. In embodiments, the pallet coupling feature 4 may be a plurality of holes such as two, three, or more.

Figure 4:
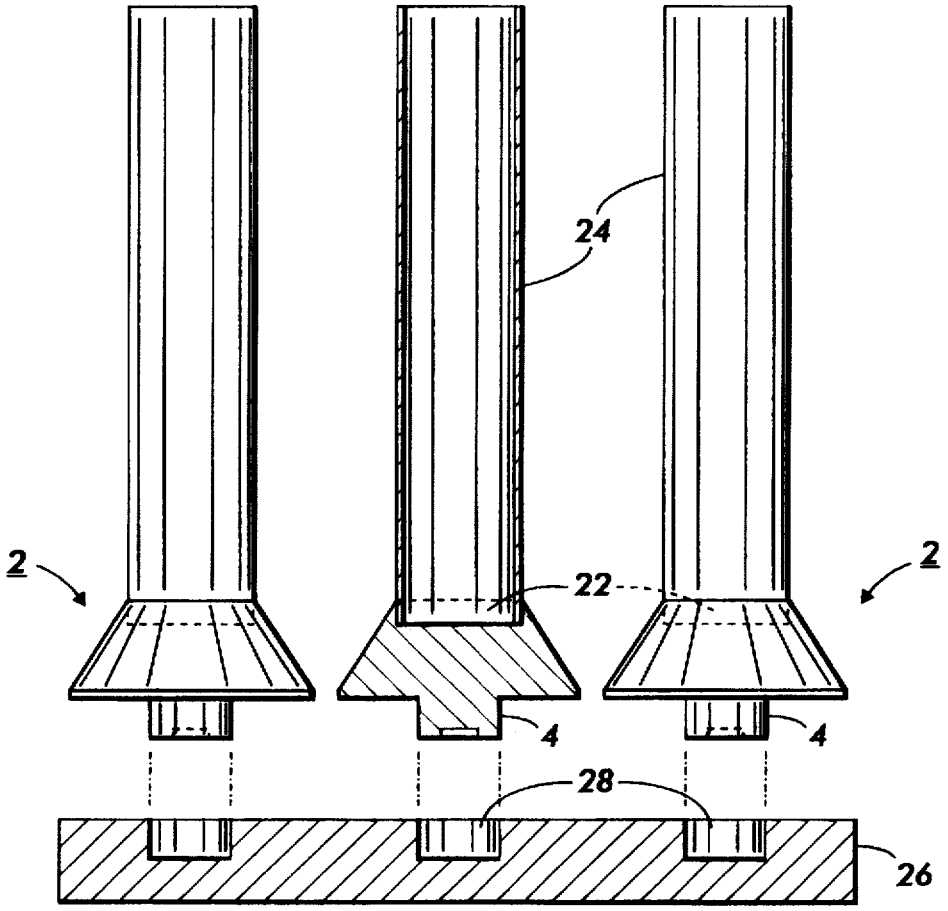
FIG. 4 represents a schematic, partial cross-sectional side view of one embodiment of the coating assembly including a plurality of substrates, a plurality of plug members of the type illustrated in FIG. 2, and one configuration of a pallet.

FIG. 4 illustrates the coupling of a plurality of plug members 2 (of the type depicted in FIG. 2) to the end region 22 of a plurality of substrates 24 and the coupling of the plug members 2 to a pallet 26 having a plurality of identical plug member coupling features 28, where each plug member coupling feature 28 is a hole. The pallet 26 is used to carry the substrate or a plurality of substrates through the coating process.

Figure 5:
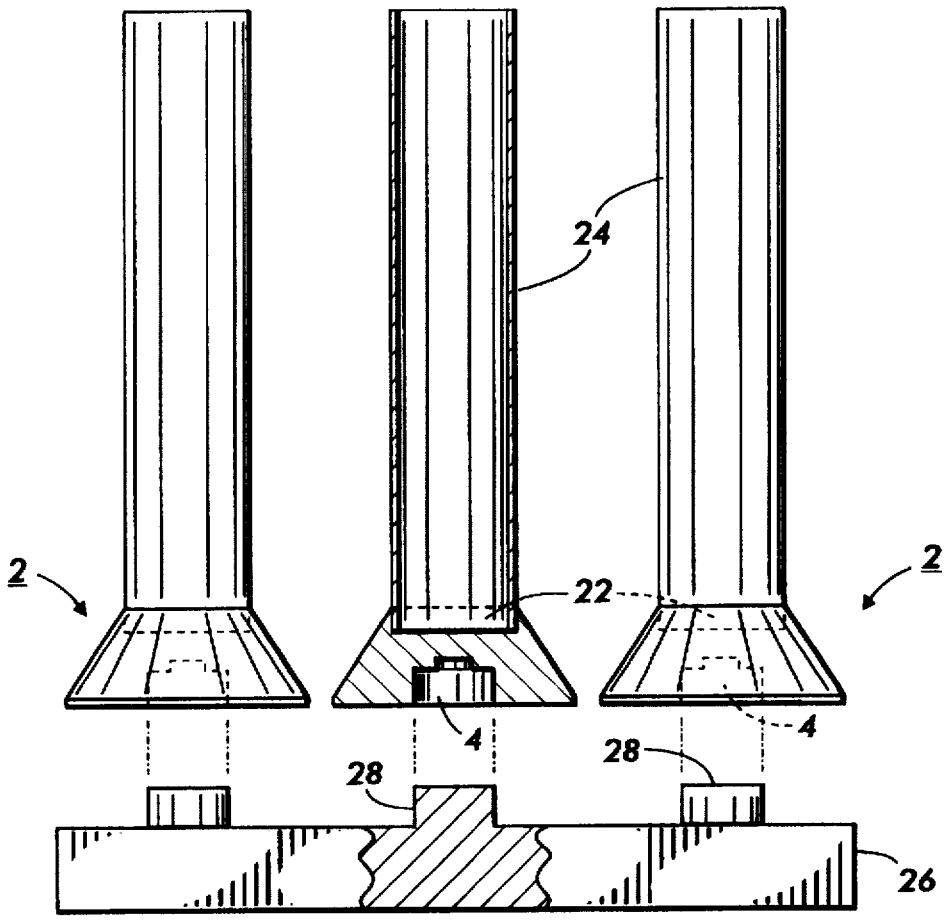
FIG. 5 represents a schematic, partial cross-sectional side view of another embodiment of the coating assembly including a plurality of substrates, a plurality of plug members of the type illustrated in FIG. 3, and a second configuration of the pallet Unless otherwise noted, the same reference numeral in different Figures refers to the same or similar feature.

FIG. 5 illustrates the coupling of a plurality of plug members 2 (of the type depicted in FIG. 3) to the end region 22 of a plurality of substrates 24 and the coupling of the plug members 2 to a pallet 26 having a plurality of identical plug member coupling features 28, where each plug member coupling feature 28 is a peg.

In embodiments of the present invention, the inner surface 16 of the plug member's side wall 14 grips the outer surface of an end region 22 of the substrate 24 with a gripping power sufficient to enable the plug member to remain coupled to the end region of the substrate during a coating process including immersion and withdrawal from a coating solution and wherein the plug member is detachable from the end region at the end of the coating process. In a preferred embodiment, the entire inner surface of the side wall contacts the entire outer surface of the end region of the substrate. Preferably, the plug member remains coupled to the end region of the substrate even during immersion and withdrawal from one, two, three, or more different coating solutions. It is preferred that there is a liquid tight seal formed between the side wall of the plug member and the end region of the substrate. Also preferred is that plug member remains coupled to the substrate even during the elevated temperatures encountered during the coating process when the various coated layers are dried.

The pallet coupling feature 4 on the plug member and the plug member coupling feature 28 on the pallet may be of any suitable configurations including but not limited to a peg/hole connection and other male/female type connections. Preferably, all the plug members used in a coating assembly regardless of their shape and size (to accommodate substrates of dissimilar inner diameters) all have pallet coupling features of the same shape and size so that the same pallet can be used with substrates and plug members of any size.

In embodiments of the present invention, one or more O-rings may be positioned in the cavity region 10 of the plug member and/or the end region 22 of the substrate to enhance the seal and the fit between the plug member and the end region of the substrate.

The plug member is preferably entirely fabricated from a nonwetting, chemically inert, and temperature resistant material such as DELRIN™ (a polyacetal available from Du Pont de Nemours) and polytetrafluoroethylene available as TEFLON™. The plug member may comprise two or more components coupled together, but preferably is a single piece.

The pallet is preferably fabricated from stainless steel and has a plurality of plug member coupling features ranging for example from 1 to 40, where each plug member coupling feature mates with a plug member (with the plug member coupled to a substrate). As is apparent, the combination of the plug member coupling feature on the pallet and the pallet coupling feature on the plug member stabilizes the plug member and the coupled substrate in the pallet.

The present invention provides a number of benefits. For example, the plug member when coupled to the substrate may be employed to center the substrate in a single substrate type dip coating vessel. In addition, the plug member minimizes or eliminates undesired coating on the end region of the substrate, thereby eliminating the conventionally employed bottom edge wipe step that removes the undesired coating. Furthermore, the same pallet can be used with different sized substrates since the pallet coupling feaure on the plug member and the plug member coupling feature on the pallet are independent of the substrate size. Using the same pallet for substrates of a different diameter eliminates the need to fabricate a pallet unique for each substrate diameter and decreases the time needed to change over the coating line to coat substrates of a different diameter. Moreover, even if the plug member were to become detached from the substrate in a coating vessel, the plug member would remain integral and thus would not contaminate the coating solution by loose debris such as chips or flakes.

The other end of the substrate is coupled to any suitable chuck assembly including the chuck assemblies disclosed in Mistrater et al, U.S. Pat. No. 5,320,364, and Swain et al, U.S. Pat. No. 5,520,399, the disclosures of which are hereby totally incorporated by reference.

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness of from about 50 Angstroms to 30 microns, although the thickness can be outside of this range. When a flexible electrophotographic imaging member is desired, the substrate thickness typically is from about 0.015 mm to about 0.15 mm. The substrate can be fabricated from any other conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®. The coated or uncoated substrate can be flexible or rigid, and can have any number of configurations such as a cylindrical drum, an endless flexible belt, and the like. The substrates preferably have a hollow, endless configuration.

Each coating solution may comprise materials typically used for any layer of a photosensitive member including such layers as a subbing layer, a charge barrier layer, an adhesive layer, a charge transport layer, and a charge generating layer, such materials and amounts thereof being illustrated for instance in U.S. Pat. No. 4,265,990, U.S. Pat. No. 4,390,611, U.S. Pat. No. 4,551,404, U.S. Pat. No. 4,588,667, U.S. Pat. No. 4,596,754, and U.S. Pat. No. 4,797,337, the disclosures of which are totally incorporated by reference.

In embodiments, a coating solution may include the materials for a charge barrier layer including for example polymers such as polyvinylbutyral, epoxy resins, polyesters, polysiloxanes, polyamides, or polyurethanes. Materials for the charge barrier layer are disclosed in U.S. Pat. Nos. 5,244,762 and 4,988,597, the disclosures of which are totally incorporated by reference.

In embodiments, a coating solution may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. A representative charge generating layer coating solution comprises: 2% by weight hydroxy gallium phthalocyanine; 1% by weight terpolymer of vinyl acetate, vinyl chloride, and maleic acid; and 97% by weight cyclohexanone.

In embodiments, a coating solution may be formed by dissolving a charge transport material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like. An illustrative charge transport layer coating solution has the following composition: 10% by weight N,N'-diphenyl-N,N'-bis(3-methylphenyl)-[1,1'-biphenyl]-4,4'diamine; 14% by weight poly(4,4'-diphenyl-1,1'-cyclohexane carbonate (400 molecular weight); 57% by weight tetrahydrofuran; and 19% by weight monochlorobenzene.

A coating solution may also contain a solvent, preferably an organic solvent, such as one or more of the following: tetrahydrofuran, monochlorobenzene, and cyclohexanone.

After all the desired layers are coated onto the substrates, they may be subjected to elevated drying temperatures such as from about 100° to about 160° C. for about 0.2 to about 2 hours.

Other modifications of the present invention may occur to those skilled in the art based upon a reading of the present disclosure and these modifications are intended to be included within the scope of the present invention.

We claim:

1. A substrate coating assembly comprising:

(a) a hollow, cylindrical substrate having a coating thereon, wherein the substrate defines a first open end region having an outer surface and an inner surface and a second open end region;

(b) a plug member fabricated from a nonwetting material, wherein the plug member has a bottom surface having a pallet coupling means and a top surface defining a cavity region encompassed by a circumferentially extending rigid side wall having an outer surface and an inner surface, wherein the first end region of the substrate is disposed in the cavity region where the inner surface of the side wall is dimensioned to detachably grip grips the outer surface of the first end region of the substrate to couple the plug member to the first end region, whereby the plug member minimizes coating of the outer surface and the inner surface of the first end region of the substrate by a coating solution; and (c) a pallet having a plurality of identical plug member reciprocal coupling means, for receiving said pallet coupling means.

2. The assembly of claim 1, wherein each of the plurality of the plug member coupling means on the pallet defines a hole.

3. The assembly of claim 1, wherein each of the plurality of the plug member coupling means on the pallet is a peg.

4. The assembly of claim 1, wherein the nonwetting material is selected from the group consisting of a polytetrafluoroethylene and a polyacetal.

5. The assembly of claim 1, wherein the cavity region defines a flat bottom surface.

6. The assembly of claim 1, wherein the outer surface of the side wall is angled.

7. The assembly of claim 1, wherein the pallet coupling means of the plug member defines a hole.

8. The assembly of claim 1, wherein pallet coupling means of the plug member is a peg.

9. The assembly of claim 1, wherein there is absent an adhesive between the inner surface of the side wall and the outer surface of the first end region.

* * * * *